US007162984B2

(12) United States Patent
Sato et al.

(10) Patent No.: US 7,162,984 B2
(45) Date of Patent: Jan. 16, 2007

(54) VALVE TIMING CONTROL SYSTEM FOR INTERNAL COMBUSTION ENGINE AND METHOD FOR ASSEMBLING SAME

(75) Inventors: Kenji Sato, Kanagawa (JP); Seiji Suga, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/349,919

(22) Filed: Feb. 9, 2006

(65) Prior Publication Data

US 2006/0180107 A1 Aug. 17, 2006

(30) Foreign Application Priority Data

Feb. 14, 2005 (JP) ..... 2005-035347

(51) Int. Cl.
*F01L 1/34* (2006.01)

(52) U.S. Cl. ..... 123/90.17; 123/90.15; 123/90.31; 464/160

(58) Field of Classification Search ..... 123/90.15, 123/90.16, 90.17, 90.18, 90.27, 90.31; 464/1, 464/2, 160
See application file for complete search history.

(56) References Cited

U.S. PATENT DOCUMENTS 6,332,439 B1 * 12/2001 Sekiya et al. ..... 123/90.17

FOREIGN PATENT DOCUMENTS

JP 3081191 8/1999

* cited by examiner

*Primary Examiner*—Ching Chang
(74) *Attorney, Agent, or Firm*—Foley & Lardner LLP

(57) ABSTRACT

A valve timing control system for an internal combustion engine includes a driving member to which a rotational force is transmitted from a crankshaft. A driven member is rotatable with a cam shaft as a single member. A phase changing mechanism is disposed between the driving member and the driven member to vary a relative rotational phase between the driving member and the driven member within an angular range. A projecting member is disposed to one of side of the driving member and side of the driven member and movable forward and rearward. A contacting section is formed at the other of the side of the driving member and the side of the driven member and contactable with the projecting member when the projecting member is moved forward so as to restrict relative rotational positions of the driving member and the driven member. A releasing mechanism is provided for moving the projecting member rearward in accordance with an engine operating condition so as to release the restriction for the relative rotational positions upon contacting between the projecting member and the contacting section. A position adjusting device is provided for adjusting and fixing relative positions of the projecting member and the contacting section.

3 Claims, 11 Drawing Sheets

VALVE TIMING CONTROL SYSTEM FOR INTERNAL COMBUSTION ENGINE AND METHOD FOR ASSEMBLING SAME

BACKGROUND OF THE INVENTION

This invention relates to improvements in a valve timing control system for an internal combustion engine, arranged to variably control opening and closing timings of engine valves such as an intake valve and an exhaust valve of the internal combustion engine in accordance with an engine operating condition, and in a method for assembling the valve timing control system.

Hitherto, various types of valve timing control systems for internal combustion engines are proposed and put into practical use. One of such valve timing control system is of a so-called vane type and disclosed in Japanese Patent No. 3081191. Briefly, this valve timing control system includes a housing having a cylindrical housing main body. Opposite openings of the housing main body are respectively closed with a front cover and a rear cover. The housing main body, the front cover and the rear cover are joined with each other as a single member through a plurality of bolts.

This housing accommodates therein a vane member fixed to an end section of a cam shaft and rotatable inside the housing. The housing further includes three shoes each of which is generally trapezoidal (in section) and formed to radially inwardly project from the inner peripheral surface of the housing. The vane member includes three vanes each of which defines a timing-advancing oil chamber and a timing-retarding oil chamber between it and the adjacent shoes.

The above-mentioned rear plate is provided at its outer peripheral side with a sprocket as a single member, so that rotational force of a crankshaft is transmitted to the sprocket through a timing chain.

The above-mentioned one vane is formed with a hole for slidable movement which hole extends in an axial direction of the one vane. A lock pin is disposed slidably movable forward and rearward in the hole. The above-mentioned rear plate is formed at its inside surface with a lock hole to or from which the above-mentioned lock pin is engaged or disengaged.

Oil pressure discharged from a pump rotationally drivable in right and reverse directions is selectively supplied to any one of the above-mentioned timing-advancing oil chamber and the timing-retarding oil chamber in accordance with the engine operating condition. Thus supplied oil pressure drives the vane member in the right and reverse directions thereby varying relative rotational phases of a timing pulley (or the sprocket) and the cam shaft, so that the opening and closing timings of the intake valve can be variably controlled.

During engine stopping, the above-mentioned lock pin is fitted into the lock hole so as to retain the relative rotational angular position of the vane member to the above-mentioned housing at an optimum position for engine starting. This prevents the vane member from flattering in a peripheral direction owing to so-called alternating torque so that a good restarting ability can be secured.

SUMMARY OF THE INVENTION

As discussed above, in the above-mentioned internal combustion engine, relatively large alternating torque owing to a biasing force of a valve spring or the like is applied from the cam shaft to the vane member at the engine starting.

Therefore, in the above-mentioned conventional valve timing control system, a clearance between the inner peripheral surface of the above-mentioned lock hole and the outer peripheral surface of the lock pin is set to be sufficiently small to suppress flattering of the vane member in the peripheral direction owing to the above-mentioned alternating torque at the engine starting.

However, if the placement between the forming position of the above-mentioned lock hole and the disposing position of the lock pin is changed, the above-mentioned lock pin may not only be difficult to fit but also provide a fear of being not able to fit into the lock hole in some cases.

As a result, there is such a possibility as not to securely fix the relative rotational positions of the housing and the vane member.

It is, therefore, an object of the present invention to provide an improved valve timing control system for an internal combustion engine which system can effectively overcome drawbacks encountered in conventional valve timing control systems for internal combustion engines.

Another object of the present invention is to provide an improved valve timing control system for an internal combustion engine, in which relative rotational positions of a driving member and a driven member can be securely restricted in accordance with an engine operating condition.

A further object of the present invention is to provide an improved valve timing control system for an internal combustion engine, in which a secure contact between a projecting member and a contacting section disposed on the sides of driving and driven members can be always accomplished at a certain rotational position during operation after the assembly and installation of the various component parts even if the component parts have manufacturing errors.

A still further object of the present invention is to provide an improved valve timing control system for an internal combustion engine, in which relative positions (defining a clearance) of a projecting member and a contacting section on the side of driving and driven members is fixed after adjustment of the relative positions by a position adjusting device, for example, during assembly and installation of various component parts.

A first aspect of the present invention resides in a valve timing control system for an internal combustion engine which system comprises a driving member to which a rotational force is transmitted from a crankshaft. A driven member is rotatable with a cam shaft as a single member. A phase changing mechanism is disposed between the driving member and the driven member to vary a relative rotational phase between the driving member and the driven member within an angular range. A projecting member is disposed to one of side of the driving member and side of the driven member and movable forward and rearward. A contacting section is formed at the other of the side of the driving member and the side of the driven member and contactable with the projecting member when the projecting member is moved forward so as to restrict relative rotational positions of the driving member and the driven member. A releasing mechanism is provided for moving the projecting member rearward in accordance with an engine operating condition so as to release the restriction for the relative rotational positions upon contacting between the projecting member and the contacting section. A position adjusting device is provided for adjusting and fixing relative positions of the projecting member and the contacting section.

With the above arrangement, for example during assembly and installation of various component parts, the relative positions (defining a clearance) of the projecting member and the contacting section is fixed after adjustment of the relative positions by the above-mentioned position adjusting device. Consequently, it is possible to always accomplish a secure contact between the above-mentioned projecting member and the contacting section at a certain rotational position during operation after the assembly and installation of the various component parts even if the component parts have manufacturing error as conventional.

As a result, it is possible to securely restrict the relative rotational positions of the above-mentioned driving member and the driven member in accordance with the engine operating condition.

A second aspect of the present invention resides in a valve timing control system for an internal combustion engine which system comprises a driving member to which a rotational force is transmitted from a crankshaft. A driven member is rotatable with a cam shaft as a single member. A phase changing mechanism is disposed between the driving member and the driven member to vary a relative rotational phase between the driving member and the driven member within an angular range. A projecting member is disposed to one of side of the driving member and side of the driven member and movable forward and rearward. A section defining a depression is formed at the other of the side of the driving member and the side of the driven member to accommodate the projecting member therein when the projecting member is moved forward to make an engagement between the depression and the projecting member so as to restrict relative rotational positions of the driving member and the driven member. A releasing mechanism is provided for moving the projecting member rearward in accordance with an engine operating condition so as to release the engagement between the projecting member and the depression. A position adjusting device is provided for adjusting and fixing relative positions of the projecting member and the depression.

With the above arrangement, a basic structure is similar to that described in the first aspect with the exception that the above-mentioned contacting section is formed as the depression serving as an example, so that operational effects similar to those in the first aspect can be obtained.

A third aspect of the present invention resides in a method for assembling a valve timing control system for an internal combustion engine which system includes a driving member to which a rotational force is transmitted from a crankshaft. A driven member is rotatable with a cam shaft as a single member. A phase changing mechanism is disposed between the driving member and the driven member to vary a relative rotational phase between the driving member and the driven member within an angular range. A projecting member is disposed to one of side of the driving member and side of the driven member and movable forward and rearward. A contacting section is formed at the other of the side of the driving member and the side of the driven member and contactable with the projecting member when the projecting member is moved forward so as to restrict relative rotational positions of the driving member and the driven member. A releasing mechanism is provided for moving the projecting member rearward in accordance with an engine operating condition so as to release the restriction for the relative rotational positions upon contacting between the projecting member and the contacting section. A position adjusting device is provided for adjusting and fixing relative positions of the projecting member and the contacting section. The method comprises the following steps in the order mentioned: (a) restricting a relative rotation between the driving member and the driven member in a condition where the position adjusting device is not operated to fix the relative positions, as a first step; (b) operating the position adjusting device to adjust a clearance between the projecting member and the contacting section, as a second step; (c) operating the position adjusting device to fix the relative position, as a third step.

With this method, at first, a condition where the driving member and the driven member is restricted is established during assembly of various component parts. Under this condition, the clearance between the above-mentioned projecting member and the contacting section can be adjusted by the position adjusting device. Consequently, it is possible to readily and securely adjust the above-mentioned clearance.

The other objects and features of this invention will become apparent from the following description with reference to the accompanying drawings.

BRIEF DESCRIPTION OF THE DRAWINGS

In the drawings, like reference numerals designate like parts and elements throughout all figures in which.

DETAILED DESCRIPTION OF THE INVENTION

Figure 1:
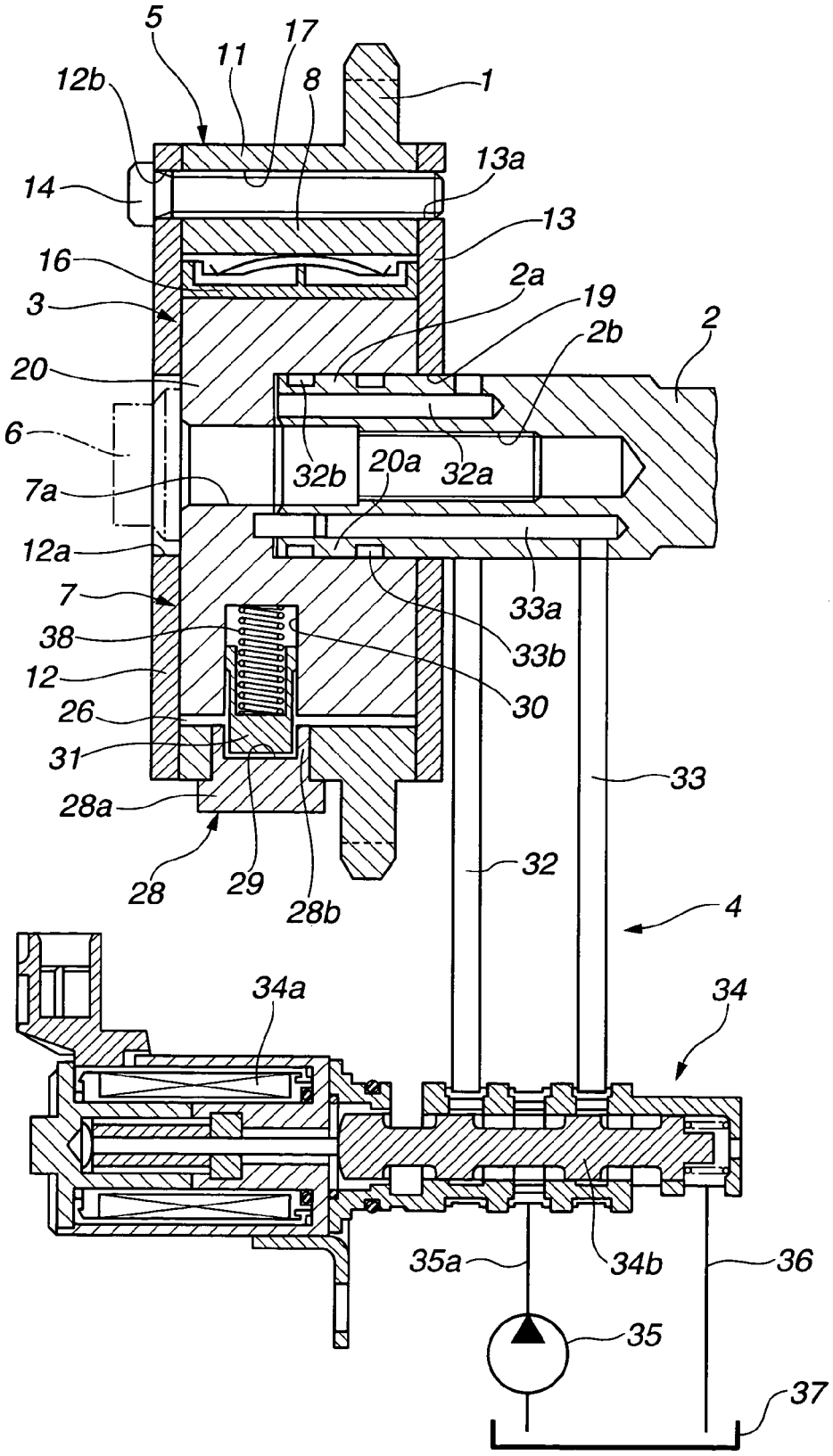
FIG. 1 is a vertical cross-sectional view of a first embodiment of a valve timing control system for an internal combustion engine, according to the present invention.
Figure 2:
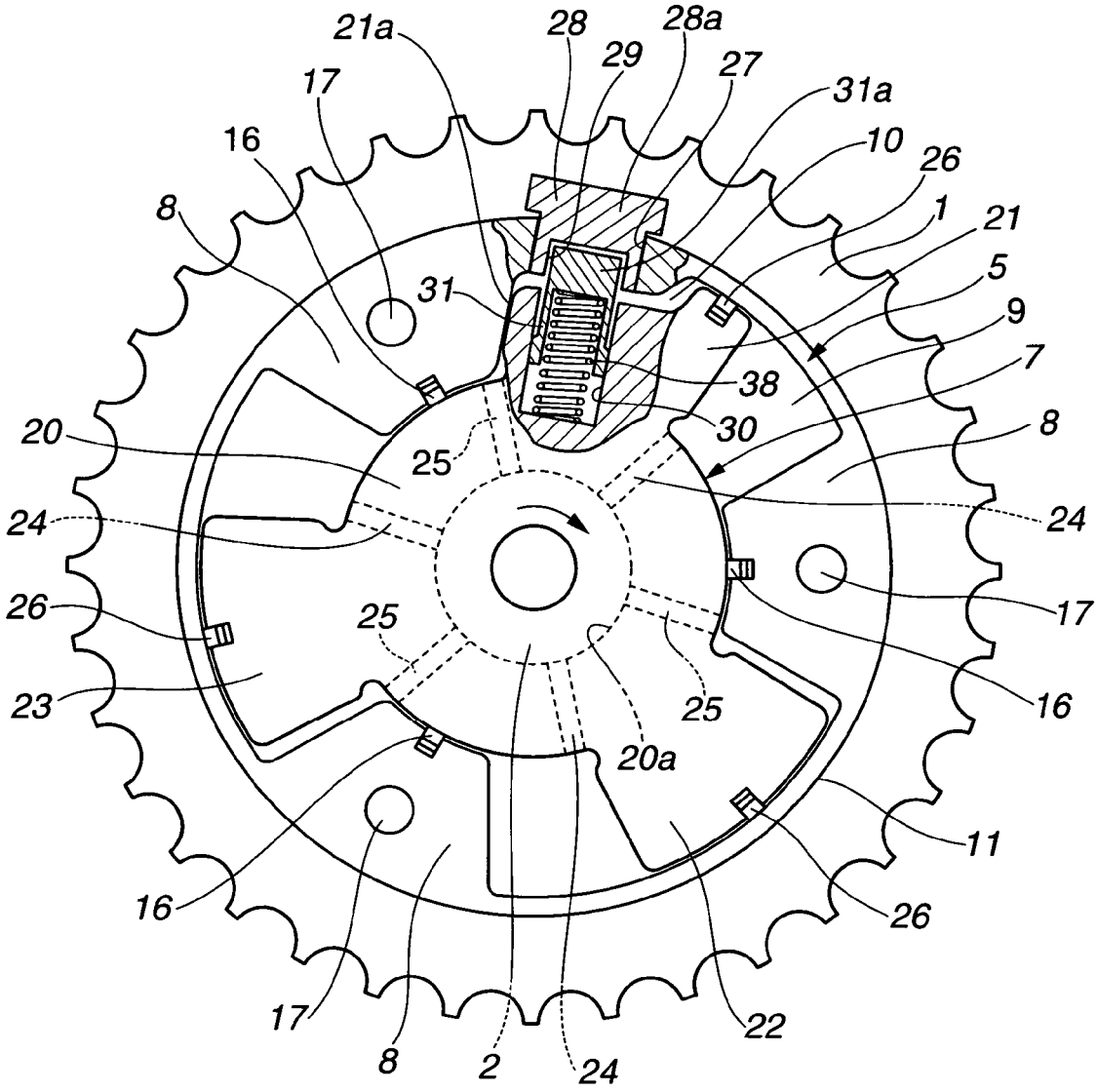
FIG. 2 is an explanatory view for explaining a state where a valve timing is controlled to a timing-retarding side in the first embodiment.
Figure 3:
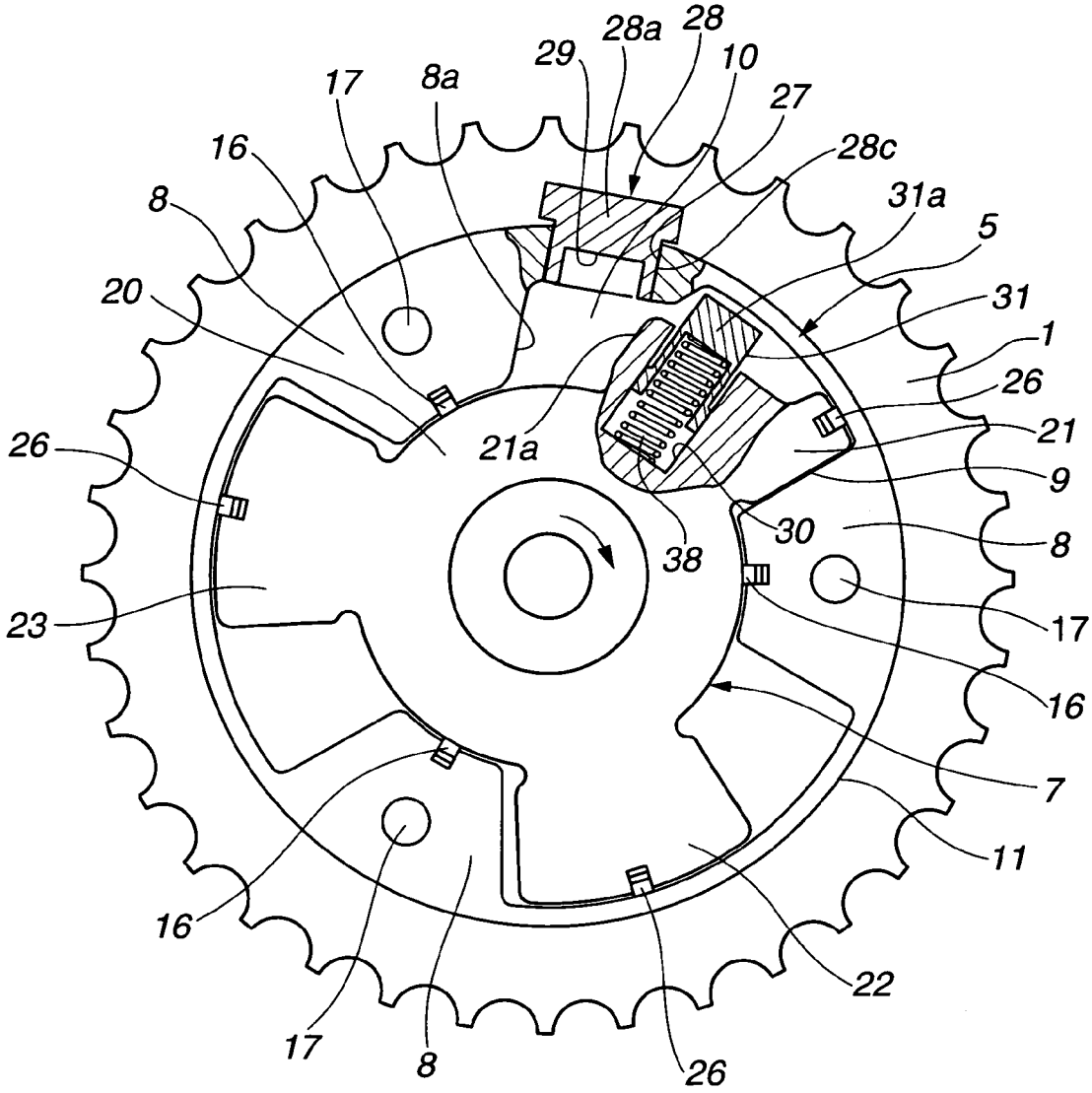
FIG. 3 is an explanatory view for explaining a state where a valve timing is controlled to a timing-advancing side in the first embodiment.

Referring now to FIGS. 1 to 3 of the drawings, a first embodiment of a valve timing control system for an internal combustion engine, according to the present invention is illustrated including sprocket 1 as a driving member rotationally driven by a crankshaft (not shown) of an engine through a timing chain. Sprocket 1 is relatively rotatable to cam shaft 2 serving as a driven member. Phase changing device 3 is disposed between sprocket 1 and cam shaft 2 so as to change relative rotational positions of the sprocket and the cam shaft to each other. Phase changing device 3 is operated by oil supplied through hydraulic circuit 4.

The abovementioned cam shaft 2 is rotatably supported by a cylinder head (not shown) through a cam bearing, and provided at a certain position of its outer peripheral surface with a plurality of driving cams as a single member. Each of the driving cams makes opening action of an intake valve through a valve lifter. Cam shaft 2 is also formed at its one end section 2*a* with an internally threaded hole 2*b* which axially extends. Cam bolt 6 (described after) is threadably inserted in hole 2*b*.

The above-mentioned phase changing device 3 is disposed to one end section of cam shaft 2 and includes housing 5, and vane member 7 which is axially fixed to the one end section of cam shaft 2 through the above-mentioned cam bolt 6 so as to be rotatably accommodated within the above-mentioned housing 5. Phase changing device 3 also has three timing-retarding oil chamber 9 (for retarding the valve timing of the intake valve when supplied with hydraulic pressure) and three timing-advancing oil chamber 10 (for advancing the valve timing when supplied with hydraulic pressure). Each of chambers 9, 10 is formed within the above-mentioned housing 5 and defined between by each of three shoes 8 provided at an inner peripheral surface of housing 5 and each of three vanes 21 to 23 (described after) of vane member 7.

The above-mentioned housing 5 includes generally cylindrical housing main body 11 which is integrally provided at its outer peripheral surface with the above-mentioned sprocket 1. Opposite open ends at front and rear sides of housing main body 11 are respectively closed by front plate 12 and rear plate 13. Housing main body 11 is axially joined with front plate 12 and rear plate 13 through three bolts 14 like a single body upon fastening with the bolts.

The above-mentioned housing main body 11 is integrally provided at its outer peripheral surface with the above-mentioned sprocket 1. Additionally, whole housing 11 and sprocket 1 are formed of sintered alloy material and subjected to a heat treatment thereby improving hardness of the whole housing main body 11 and sprocket 1 during production.

Housing main body 11 is integrally provided at its inner peripheral surface with the above-mentioned three shoes 8 each of which is formed projecting and located at generally equal intervals in the inner periphery of housing main body 11. Each shoe 8 is formed generally fan-shaped in side view and includes a sealing groove which is formed at a tip end section of each shoe 8 and extends along an axial direction of cam shaft 2. Seal member 16 is fittingly fixed in sealing groove and has a generally C-shaped cross-section. Additionally, each shoe 8 is piercingly formed with bolt insertion hole 17 at a base side of each shoe 8, the hole extending in the axial direction of cam shaft 2. Into the hole, the above-mentioned each bolt 14 is insertable.

The above-mentioned front plate 12 is formed into a shape of a relatively thin disk by press forming. Front plate 12 is formed at its central section with large diameter hole 12*a* into which the above-mentioned cam bolt 6 is insertable, and at its outer peripheral side with three bolt holes 12*b* located at equal intervals in peripheral direction. Each bolt hole 12*b* pierces front plate 12 so that the above-mentioned each bolt 14 is insertable into each bolt hole 12*b*.

The above-mentioned rear plate 13 is formed disk-shaped by similar press forming and has a thickness generally same as that of front plate 11. Rear plate 13 is formed at its central section with supporting hole 19 into which one end section 2*a* of the above-mentioned cam shaft 2 is insertable so that cam shaft 2 is rotatably supported in supporting hole 19. Rear plate 13 is also formed at its outer peripheral side with female thread holes 13*a* at equal intervals in peripheral direction. A male thread formed at a tip end section of each bolt 14 is engaged with each thread hole 13*a*.

The above-mentioned vane member 7 is formed of metal material as a single body and constituted of vane rotor 20 fixed to one end section 2*a* of cam shaft 2 in the axial direction of cam shaft 2 with the above-mentioned cam bolt 6 which is inserted into a central insertion hole 7*a* in the axial direction of cam bolt 6. Vane rotor 20 is provided on its outer peripheral surface with three vanes 21 to 23 which are radially outwardly projected and located at generally equal intervals in a peripheral direction of vane rotor 20.

The above-mentioned vane rotor 20 is slidably contacted with and rotatably supported by seal member 16 which is fittingly fixed to an upper surface of the tip end section of the above-mentioned each shoe 8. Vane rotor 20 is also formed at the central section of an end face (faced to cam shaft 2) with fitting groove 20*a* so as to fit with a tip end portion of one end section 2*a* of the above-mentioned cam shaft 2. Additionally, vane rotor 20 includes thereinside three timing-retarding side oil holes 24 and three timing-advancing side oil holes 25 which are radially piercingly formed so that each of timing-retarding side oil holes 24 and each of timing-advancing side oil holes 25 are respectively communicable with the above-mentioned each timing-retarding oil chamber 9 and the above-mentioned each timing-advancing oil chamber 10.

The above-mentioned each vane 21 to 23 is disposed between adjacent shoes 8 and has a sealing groove formed at a tip end section of each vane 21 to 23 to extend in the axial direction of the vane. Seal member 26 which is generally C-shaped in cross-section is fittingly fixed in the sealing groove and slidably contacted with inner peripheral surface 11*a* of the above-mentioned housing main body 11.

A lock mechanism is disposed between the above-mentioned one vane 21 and the above-mentioned housing main body 11 in order to restrict free rotation of vane member 7. Additionally, a position adjusting means or device for adjusting position of the lock mechanism is also disposed to the lock mechanism as a single body.

The above-mentioned lock mechanism has supporting hole 27 which is formed at an extended portion located at a most-retarded side position (at which the valve timing of the intake valve is most retarded) of the above-mentioned one vane 21 of housing main body 11 and radially extends. Press-fitting member 28 is press-fitted and fixed in supporting hole 27 and has lock hole 29 which is formed at the tip end face of press-fitting member 28 as a contacting section (depression). The above-mentioned one vane 21 is formed with concave-shaped hole 30 for slidable movement which hole radially extends to open to the peripheral surface thereof Lock pin 31 is accommodated within hole 30 for slidable movement in such a manner as to be movable forward (in a direction toward housing main body 11) and rearward so as to be engageable with and disengageable from the above-mentioned lock hole 29. The above-mentioned lock pin 31 is put into an engagement with or a disengaged from lock hole 29 by an engagement and disengagement mechanism including a releasing mechanism for disengaging the lock pin in accordance with an engine starting condition.

This engagement and disengagement mechanism includes coil spring 38 which is loaded between a bottom of an inner space of lock pin 31 and hole 30 for slidable movement thereby biasing lock pin 31 in a forward movable direction. The above-mentioned lock hole 29 is supplied with hydraulic pressure through a releasing hydraulic passage (not shown) so as to move lock pin 31 rearward. Hydraulic pressure selectively supplied to the above-mentioned timing-retarding oil chamber 9 or timing-advancing oil chamber 10 is flown through this releasing hydraulic passage.

The above-mentioned position adjusting device includes the above-mentioned supporting hole 27, press-fitting member 28, lock hole 29 and lock pin 31.

Figure 4:
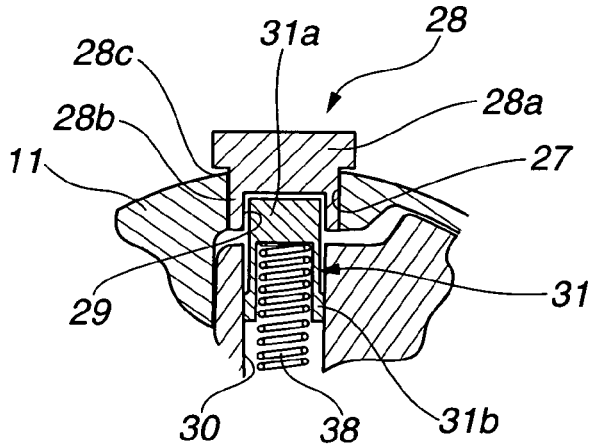
FIG. 4 is a fragmentary sectional view of an essential part of the first embodiment.

That is to say, the above-mentioned supporting hole 27 is radially formed generally cylindrical in the above-mentioned housing main body 11. On the other hand, as shown in FIGS. 4 and 5, the above-mentioned press-fitting member 28 includes generally hexagonal head section 28*a* which is fittable with a certain rotating jig, and shaft section 28*b* which is integrally disposed to the central portion of head section 28*a* and has a cylindrical and smooth outer peripheral surface.

This shaft section 28*b* has an outer diameter which is generally the same as an inner diameter of the above-mentioned supporting hole 27. However, shaft section 28*b* includes step portion 28*c* which is formed on the outer peripheral surface at the generally middle part in an axial direction, in which the outer diameter at the tip end side relative to this step portion 28*c* is generally the same as the inner diameter of the above-mentioned supporting hole 27, while that at the side of head section 28*a* relative to step portion 28*c* is slightly larger than the inner diameter of supporting hole 27.

Figure 5A:
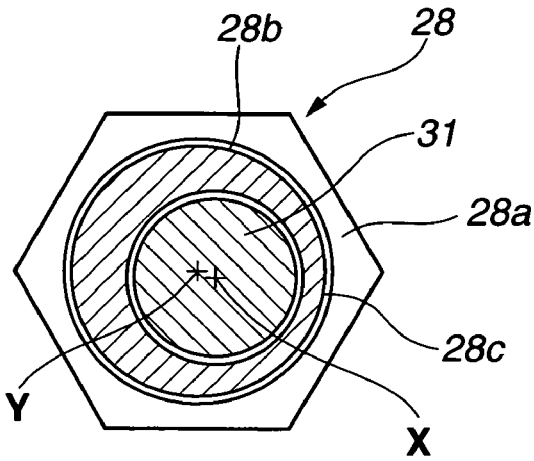
FIG. 5A is a cross-sectional view of an essential part of the first embodiment showing a first step of a procedure for locational adjustment between a lock hole and a lock pin.
Figure 5B:
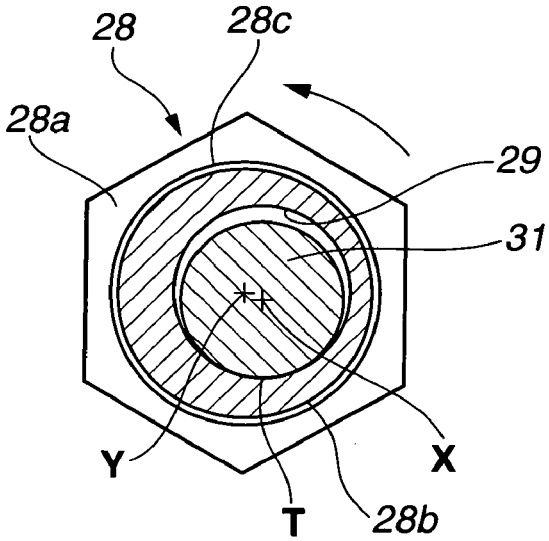
FIG. 5B is a cross-sectional view similar to FIG. 5A but showing a second step of the procedure for the locational adjustment between the lock hole and the lock pin.
Figure 5C:
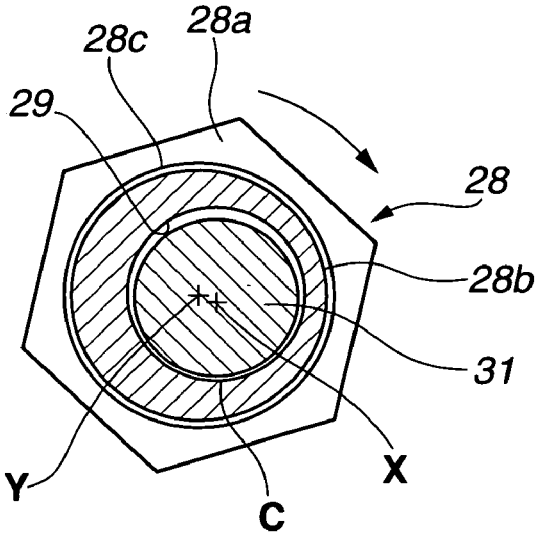
FIG. 5C is a cross-sectional view similar to FIG. 5A but showing a third step of the procedure for the locational adjustment between the lock hole and the lock pin.

The above-mentioned shaft section 28*b* is formed thereinside with the above-mentioned lock hole 29 which is designed in such a manner, as shown in FIGS. 5A to 5C, that an inner diameter thereof is sufficiently larger than an outer diameter of the above-mentioned lock pin 31, and that an axis X thereof is positioned slightly eccentric to an axis Y of the above-mentioned shaft section 28*b*.

Whole the above-mentioned lock pin 31 including tip end section 31*a* is formed generally cylindrical and includes cylindrical slidable contacting section 31*b* which is formed at the axially inward section of lock pin 31 and slidably contactable with inner peripheral surface of the above-mentioned hole 30 for slidable movement.

Additionally, the above-mentioned lock pin 31 is brought into engagement with an inside of the above-mentioned lock hole 29 in a state as shown in FIG. 2 where at least side surface 21*a* of the above-mentioned one vane 21 is in contact with side surface 8*a* of one shoe 8 facing side surface 21*a* when vane member 7 has been rotatably moved to its most-retarded side position where the valve timing of the intake valve is most retarded. In this engagement state, adjustment is made such that clearance C is slightly formed between the outer peripheral surface of lock pin 31 and the inner peripheral surface of lock hole 29 even at a section where the outer peripheral surface of lock pin 31 is approached nearest to the inner peripheral surface of lock hole 29.

The above-mentioned hydraulic circuit 4 is provided for selectively supplying hydraulic pressure to any of the above-mentioned oil chambers 9 and 10, or for draining oil within oil chambers 9 and 10. As shown in FIG. 1, hydraulic circuit 4 includes timing-retarding side passage 32 which is communicable with the above-mentioned timing-retarding side oil hole 24, and timing-advancing side passage 33 which is communicable with the above-mentioned timing-advancing side oil hole 25. Oil pump 35 selectively supplies hydraulic pressure through electromagnetic change-over valve 34 to any of the above-mentioned passages 32 and 33. Drain passage 36 is selectively communicable through electromagnetic change-over valve 34 with any of the above-mentioned passages 32 and 33.

The above-mentioned passages 32 and 33 are respectively in communication with the above-mentioned oil holes 24 and 25 through oil passage holes 32*a* and 33*a* and grooves 32*b* and 33*b*. Each of oil passage holes 32*a* and 33*a* and each of grooves 32*b* and 33*b* are formed inside the above-mentioned cam shaft 2 and extend respectively in an axial direction and a radial direction.

The above-mentioned electromagnetic change-over valve 34 is a two-way valve, in which electromagnetic coil 34*a* is energized or deenergized upon on and off of a control current output from a controller (not shown) so as to move spool valve body 34*b* to the left and the right. As a result, connection between each passage 32 or 33 and discharge passage 35*a* of oil pump 35 or the above mentioned drain passage 36 is controlled to be selectively changed-over.

The above-mentioned controller includes thereinside a computer which is supplied with information signals from various sensors such as a crank angle sensor, an air flow meter, an engine coolant temperature sensor, a throttle valve opening degree sensor thereby detecting an engine operating condition at the current time, and outputs the control current to the above mentioned electromagnetic coil 34*a* of electromagnetic change-over valve 34 in accordance with the detected engine operating condition.

Next, operation of the above valve timing control system according to this embodiment will be discussed hereinafter.

At the engine starting, tip end section 31*a* of lock pin 31 has been previously fitted, as shown in FIG. 2, within lock hole 29 so that vane member 7 is held at the timing-retarded side position which is optimum for the engine starting. Consequently, when the engine is started upon ON-operation of an ignition switch, good startability due to smooth cranking can be obtained.

Within a certain low engine speed and low engine load range after the engine starting, the controller interrupts current supply to electromagnetic coil 34*a* of electromagnetic change-over valve 34. By this, discharge passage 35*a* of oil pump 35 is brought into communication with timing-advancing side passage 33 through spool valve body 34*b*, and simultaneously, timing-retarding side passage 32 is brought into communication with drain passage 36.

As a result, hydraulic oil discharged from oil pump 35 is supplied into timing-advancing oil chamber 10 through timing-advancing side passage 33 so that a high pressure prevails inside timing-advancing oil chamber 10, while hydraulic oil within timing-retarding oil chamber 9 is discharged through timing-retarding side passage 32 and drain passage 36 into oil pan 37 so that a high pressure prevails inside timing-retarding oil chamber 9 becomes low in pressure.

At this time, hydraulic pressure supplied into timing-advancing oil chamber 10 is flowed into lock hole 29 through the above-mentioned releasing hydraulic passage so that lock pin 31 is moved rearward against biasing force of coil spring 38. Therefore, tip end section 31*a* of lock pin 31 gets out of lock hole 29 so that vane member 7 secures its freely rotation.

Consequently, according to enlargement of volume of timing-advancing chamber 10, vane member 7 is rotationally moved clockwise as shown in FIG. 3. As a result, a relative rotational angle of cam shaft 2 to sprocket 1 is changed to a timing-advancing side where the valve timing of the intake valve is relatively advanced.

On the other hand, when engine operation is changed into, for example, a high engine speed and high engine load range, the control current is output from the controller to electromagnetic coil 34*a* of electromagnetic change-over valve 34 so as to establish a communication of discharge passage 35*a* with timing-retarding side passage 32 through spool valve body 34*b*, and to simultaneously establish communication of timing-advancing side passage 33 with drain passage 36. By this, hydraulic oil within timing-advancing oil chamber 10 is discharged to become low in pressure, while timing-retarding oil chamber 9 is supplied with hydraulic oil thereby becoming high in pressure.

At this time, hydraulic pressure within the above-mentioned timing-retarding oil chamber 9 is supplied into lock hole 29 through the above-mentioned releasing hydraulic passage so that lock pin 31 is kept in a condition where it gets out of lock hole 29 is maintained.

By this, vane member 7 is rotationally moved, as shown in FIG. 2, counterclockwise relative to housing 5 thereby changing a relative rotational phase thereof to sprocket 1 to a timing-retarding side so that the valve timing of the intake valve is relatively retarded.

As a result, opening and closing timings of the intake valve are controlled to the timing-retarding side thereby improving an power output of the engine in such a high engine speed and high engine load range.

Additionally, at a timing immediately before stopping of engine operation, i.e., when the ignition switch is turned off, current supply to electromagnetic change over valve 34 is interrupted. Therefore, spool valve body 34*b* closes three passages 32, 33 and 36 thereby stopping supply of hydraulic pressure into oil chambers 9 and 10.

Simultaneously, vane member 7 makes its relative rotational movement to the above-mentioned timing-retarding side under the action of alternating torque applied to cam shaft 2, and therefore lock pin 31 is advanced or moved forward under the biasing force of coil spring 38 so that tip end section 31*a* of lock pin 31 is fitted into lock hole 29. In this case, precise positioning between lock pin 31 and lock hole 29 has been previously made during assembly of various component parts by the position adjusting device as will be described below, and therefore smooth fitting effect of lock pin 31 to lock hole 29 can be obtained.

That is to say, in this embodiment, in order to make position adjustment between lock hole 29 and lock pin 31 by the position adjusting device during the assembly of the various component parts, first lock pin 31 and coil spring 38 are previously disposed, as shown in FIGS. 4 and 5A, within hole 30 for slidable movement.

Next, vane member 7 is brought into contact with the side surface of shoe 8 with which the side surface of one vane 21 faces, through cam shaft 2 (First step).

Thereafter, only the tip end side of press-fitting member 28 is pressingly fitted into supporting hole 27 of the above-mentioned housing main body 11 so as to fit tip end section 31*a* of lock pin 31 into lock hole 29. At this state as shown in FIG. 5A, an entirely annular and relatively large clearance C is formed between the inner peripheral surface of lock hole 29 and the outer peripheral surface of tip end section 31*a* of lock pin 31.

At this state, press-fitting member 28 is turned counterclockwise (in a direction indicated by an arrow) as shown in FIG. 5B through head section 28*a* so that lock hole 29 whose axis X is eccentric is eccentrically displaced. Consequently, a part of the inner peripheral surface of lock hole 29 is brought into sliding contact with a part of the outer peripheral surface of tip end section 31*a* of lock pin 31 in a peripheral direction at contacting sections T so that the clearance C is lost at the contacting sections T.

Next, press-fitting member 28 is turned in a reverse direction (in a direction indicated by an arrow in figure) by a certain slight angle as shown in FIG. 5C. By this, the above-mentioned contacting sections are separated from each other so that slight clearance C is again formed between the inner peripheral surface of lock hole 29 and the outer peripheral surface of lock pin 31 (Second step).

Thereafter, at this state, press-fitting member 28 is further strongly pressingly fitted into supporting hole 27 so that the outer peripheral surface of step portion 28*c* is strongly pressingly contacted and fixed to the inner peripheral surface of supporting hole 27. Therefore, the above-mentioned press-fitting member 28 is securely restrained from free rotation so that the relative position of lock pin 31 to lock hole 29 is adjusted in such a manner that slight clearance C is again formed at a part between lock pin 31 and lock hole 29 (Third step). By this, the above-mentioned position adjustment operation is readily and securely completed.

As discussed above, according to this embodiment, even if the component parts have manufacturing errors as in a conventional technique, vane member 7 is positioned at the relative rotational position on the most timing-retarding side when the engine operation stops as discussed above, in which the relative position of the above-mentioned lock pin 31 to lock hole 29 is always securely set optimum.

As a result, it is possible to securely restrict the relative rotational position of the above-mentioned sprocket 1 to cam shaft 2 at the engine starting.

As discussed above, press-fitting member 28 is rotated in left or right direction through head section 28*a* so as to form slight clearance C. Thereafter, upon maintaining this state, press-fitting member 28 is pressingly fitted and fixed in supporting hole 27. Consequently, adjustment operation is extremely facilitated, while it is possible to securely and readily set the above-mentioned clearance C.

Furthermore, the above-mentioned press-fitting member 28 is in firm connection with supporting hole 27 through step portion 28*c* so that press-fitting member 28 is prevented from its improper rotation during engine operation.

Additionally, in this embodiment, tip end section 31*a* of lock pin 31 is formed cylindrical so as to make it possible to equalize entire clearance between the outer peripheral surface of the above-mentioned tip end section 31*a* and the inner peripheral surface of the above-mentioned lock hole 29 as compared with a case in which tip end section 31*a* is formed, for example, tapered shape. Furthermore, the clearance can be set as small as possible so as to make it possible to suppress generation of slapping sound between tip end section 31*a* and lock hole 29. As a result, this embodiment is effective to prevent generation of foreign noise between the above-mentioned tip end section 31*a* and lock hole 29.

FIGS. 6 to 9 show a second embodiment of the valve timing control system according to the present invention similar to the first embodiment, with the exception that the press-fitting member of the position adjusting device is not employed, and adjusting member 40 which is threadably fixed and not press-fitted is employed.

More specifically, this adjusting member 40 includes head section 40*a* formed disc shape and shaft section 40*b* whose outer diameter is set slightly smaller than the inner diameter of the above-mentioned supporting hole 27 so as to be freely rotatable within supporting hole 27. Additionally, an outer peripheral side of the above-mentioned head section 40*a* is formed with arcuate elongated hole 42 which serves as a position allowance section. Into the elongated hole 42, guide pin 41 is inserted projecting to the outer peripheral surface of an end section side of shoe 8 of the above-mentioned housing main body 11 so as to allow adjusting member 40 to rotate within a certain angular range.

The above-mentioned guide pin 41 is formed at its outer peripheral surface with a male thread which is threadably fixable with lock nut 43 serving as a fixing means for fixing the above-mentioned adjusting member 40 in a certain rotational angular position.

The above-mentioned shaft section 40*b* is formed thereinside with lock hole 29 which is similar to that in the first embodiment, in which axis X of the lock hole is positioned eccentric to axis Y of shaft section 40*b*. Other structure including the above-mentioned lock pin 31 is similar to that in the first embodiment.

Figure 6:
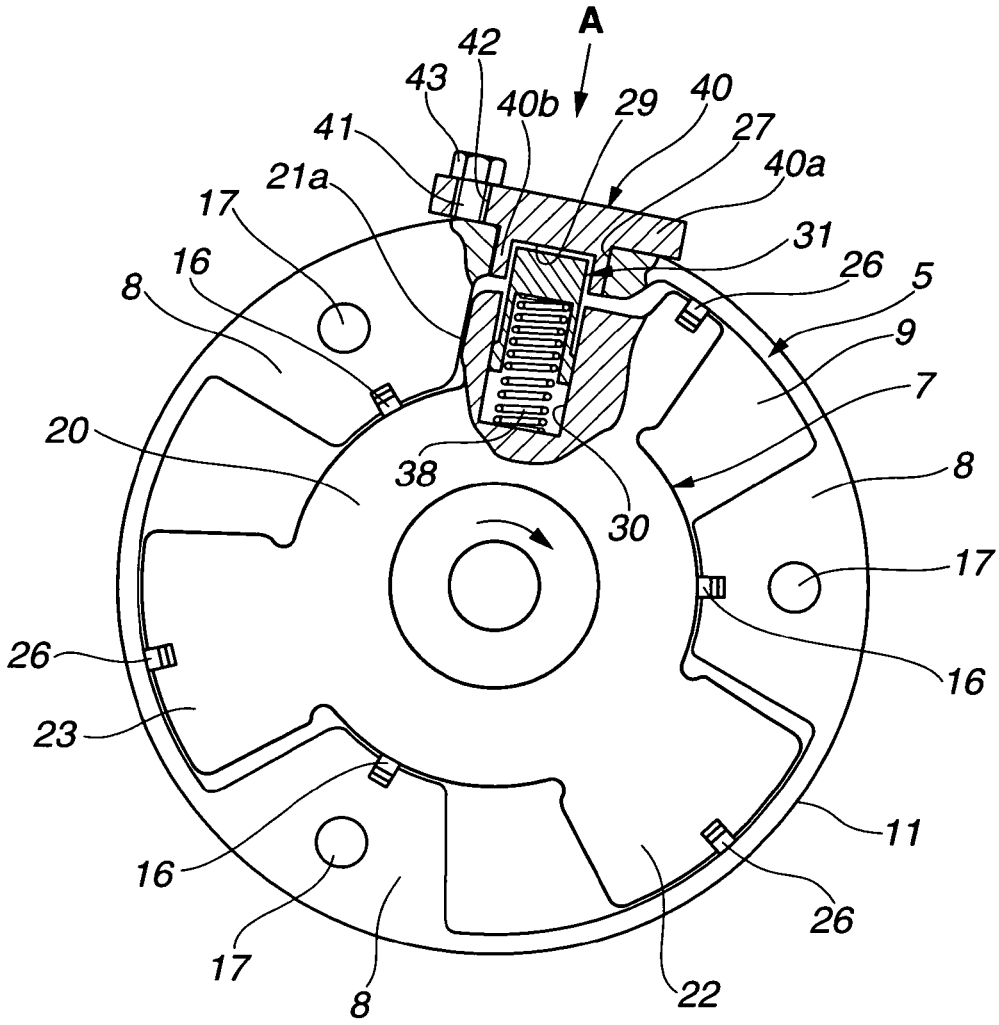
FIG. 6 is an explanatory view similar to FIG. 3 but showing a second embodiment of the valve timing control system for an internal combustion engine, according to the present invention.
Figure 7:
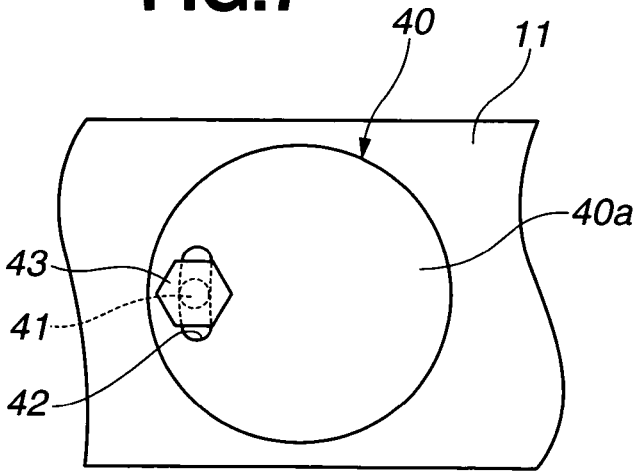
FIG. 7 is a fragmentary view as viewed from a direction of an arrow A in FIG. 6.

Therefore, in order to accomplish the position adjustment of lock hole 29 to lock pin 31 by the above-mentioned adjusting member 40, first as shown in FIG. 6, side surface 21*a* of one vane 21 of vane member 7 is contacted with side surface 8*a* of shoe 8 during assembly operation of various component parts.

Figure 8:
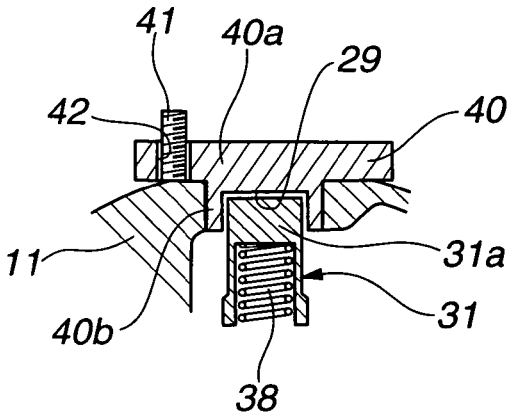
FIG. 8 is a fragmentary view of an essential part of the second embodiment.
Figure 9A:
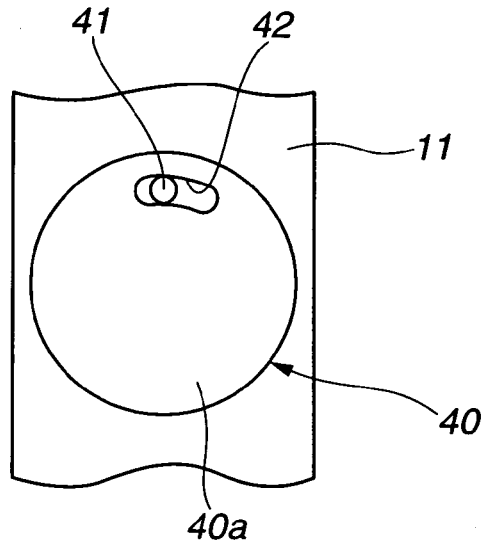
FIG. 9A is a fragmentary view of an essential part of the second embodiment showing a first step of a procedure for locational adjustment between a lock hole and a lock pin.

Thereafter, in this contacting condition, shaft section 40*b* of adjusting member 40 fittingly enters supporting hole 27 so that tip end section 31*a* of lock pin 31 fittingly enters lock hole 29, and the above-mentioned guide pin 41 is inserted into the above-mentioned elongated hole 42 as shown in FIGS. 8 and 9A.

Figure 9B:
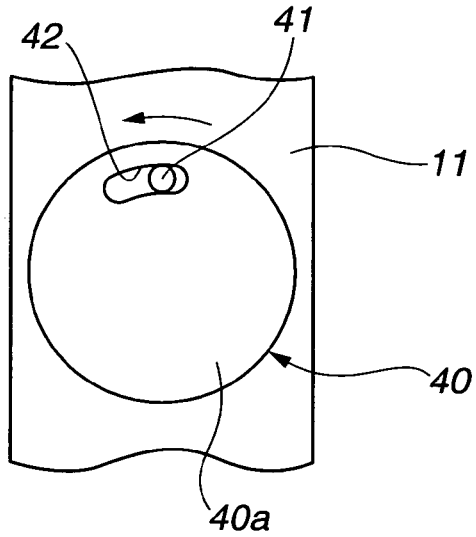
FIG. 9B is a fragmentary view similar to FIG. 9A but showing a second step of the procedure for the locational adjustment between the lock hole and the lock pin.

Next, as shown in FIG. 9B, adjusting member 40 is gradually turned, for example, counterclockwise (in a direction of an arrow) in the figure around shaft section 40*b* upon handling head section 40*a* through elongation hole 42 until a part of the inner peripheral surface of lock hole 29 eccentrically formed is contacted with a part of the outer peripheral surface of the above-mentioned lock pin 31. Therefore, adjusting member 40 is in a state where a part of clearance C is lost between the inner peripheral surface of lock hole 29 and the outer peripheral surface of lock pin 31.

Figure 9C:
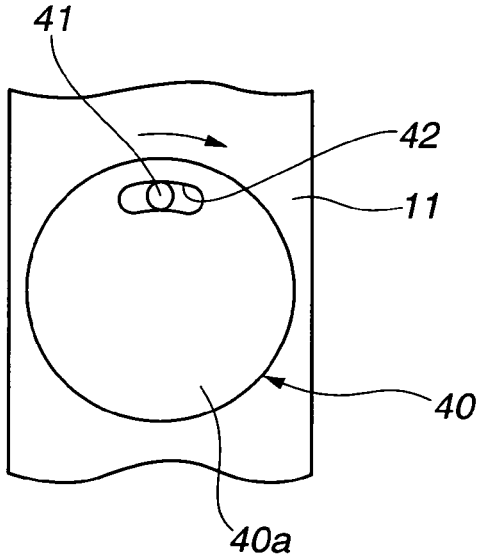
FIG. 9C is a fragmentary view similar to FIG. 9A but showing a third step of the procedure for the locational adjustment between the lock hole and the lock pin.

Subsequently, at this time, adjusting member 40 is turned as shown in FIG. 9C, clockwise (in a direction of an arrow) by a certain amount through elongation hole 40. Consequently, certain slight clearance C is formed between contacting sections of the outer peripheral surface of the tip end section of the above-mentioned lock pin 31 and the inner peripheral surface of lock hole 29, similar to the case shown in FIG. 5C.

At this state, the above-mentioned lock nut 43 is threadably fixed with and fastened on the upper end section of guide pin 41 so that adjusting member 40 can be readily fixed to housing main body 11.

According to this embodiment, adjustment operation is accomplished only by preferably adjusting positioning between lock pin 31 and lock hole 29 upon right and reverse rotations of adjusting member 40 and finally fastening lock nut 40, thereby extremely facilitating the adjustment operation.

Additionally, according to this embodiment, it is possible to repeatedly and readily adjust the clearance by rotating adjusting member 40 upon loosening the above-mentioned lock nut 43, after long-term operation of the engine.

Relative rotational phase between the above-mentioned sprocket 1 and cam shaft 2 is changeably controlled similarly to the first embodiment.

Figure 10:
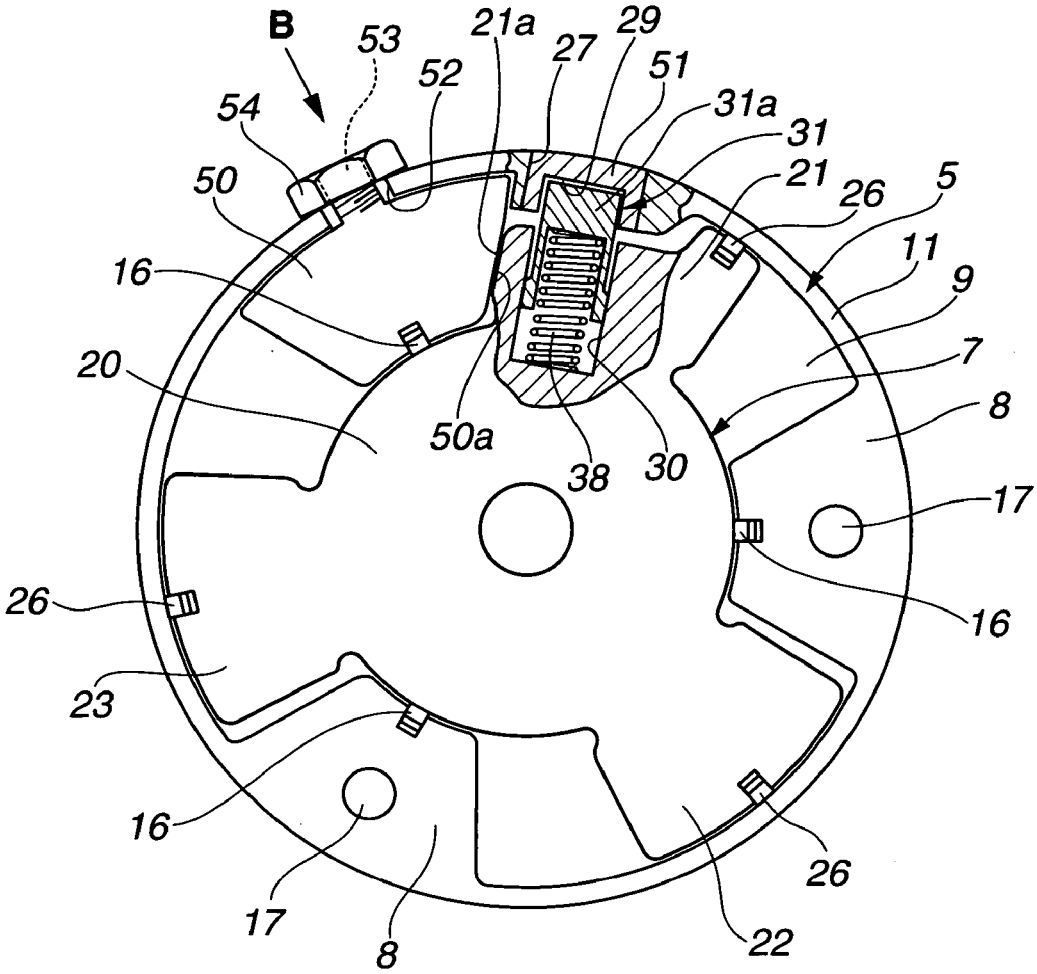
FIG. 10 is an explanatory view similar to FIG. 3 but showing a third embodiment of a valve timing control system for an internal combustion engine, according to the present invention.
Figure 11:
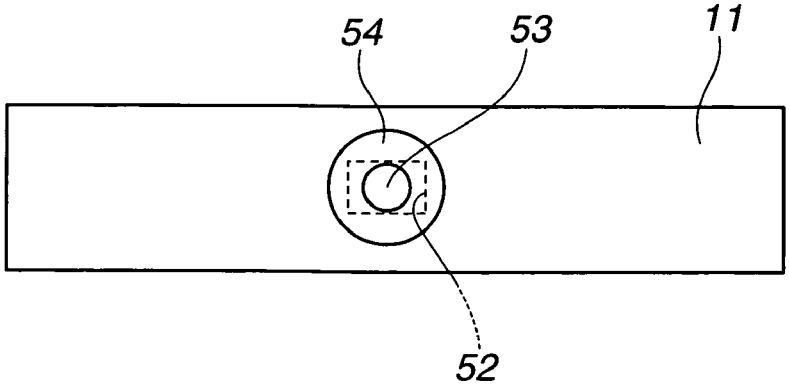
FIG. 11 is a view as viewed from a direction of an arrow B in FIG. 10.

FIGS. 10 to 12 show a third embodiment of the valve timing control system according to the present invention, similar to the first embodiment with the exception that the clearance is adjusted by moving lock pin 31 through vane member 7 upon moving one shoe 50 in a peripheral direction and not by rotating the press-fitting member or the adjusting member.

More specifically, housing main body 11 is formed with supporting hole 27 into which supporting member 51 formed with lock hole 29 is fixed upon press-fitting. The above-mentioned lock hole 29 is formed in such a manner that its axis is coaxial with that of supporting member 51, different from the above-mentioned embodiments in which the lock hole 29 is eccentric.

Structure and arrangement of hole 30 for slidable movement, lock pin 31 and the like formed at one vane 21 are similar to those in the above-mentioned embodiments.

The above-mentioned housing main body 11 is formed with guiding elongated hole 52 which is located at a section of the housing main body 11 corresponding to the above-mentioned one shoe 50 and extends along in a peripheral direction to be formed generally rectangular shape having a certain length. The above-mentioned one shoe 50 is formed in the shape of a block fan-shaped in front elevation and separated from housing main body 11. One shoe 50 is also provided at the peripherally central section of its outer peripheral surface with projected guide pin 53 which is insertable into the above-mentioned guiding elongated hole 52. This guide pin 53 is formed at its outer peripheral surface with a male thread with which lock nut 54 is threadably fixed from the outside of housing main body 11.

Figure 12A:
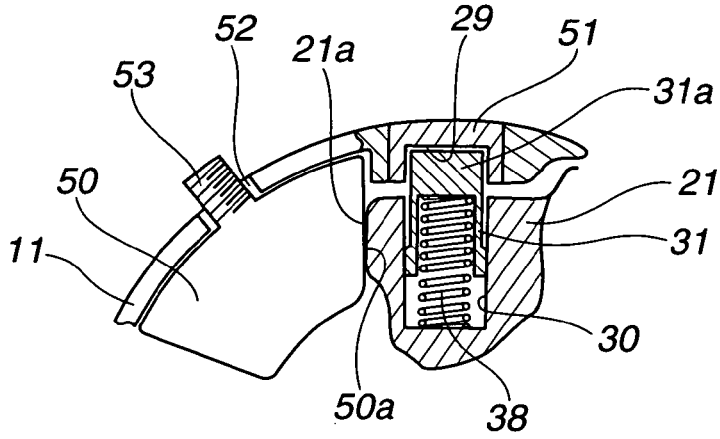
FIG. 12A is a cross-sectional view of an essential part of the third embodiment showing a first step of a procedure for locational adjustment between a lock hole and a lock pin.

Therefore, in order to adjust positioning between the above-mentioned lock hole 29 and lock pin 31 during assembly of various component parts, firstly as shown in FIG. 12A, lock pin 31 is located in a state of being fitted in lock hole 29, and additionally the above-mentioned shoe 50 is located in a free state at which guide pin 53 is inserted into guiding elongated hole 52. At this state, lock pin 31 is being located at the generally center of lock hole 29.

Figure 12B:
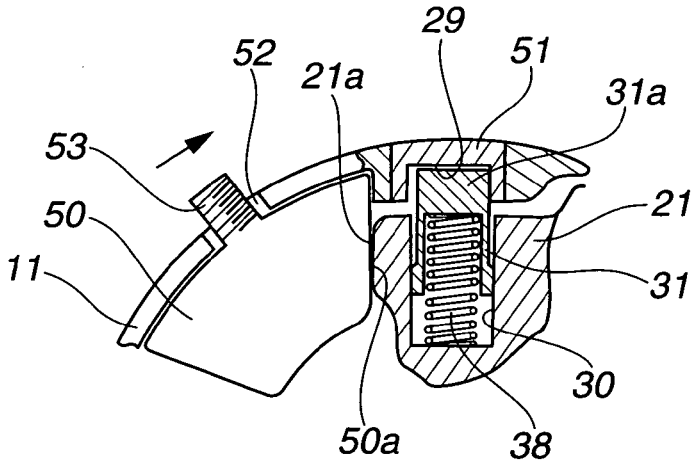
FIG. 12B is a cross-sectional view similar to FIG. 12A but showing a second step of the procedure for the locational adjustment between the lock hole and the lock pin.

At this state, the above-mentioned shoe 50 is slightly moved, as shown in FIG. 12B, clockwise (in a direction of an arrow) along the inner peripheral surface of housing main body 11 through guiding elongated hole 52 and guide pin 53. Consequently, vane 21 is slightly moved along the peripheral direction same as the moving direction of shoe 50 upon being pushed by side surface 50*a* of shoe 50. By this, lock pin 31 is moved within lock hole 29 thereby contacting a part of the inner peripheral surface of lock hole 29 with a part of the outer peripheral surface of lock pin 31 to each other.

Figure 12C:
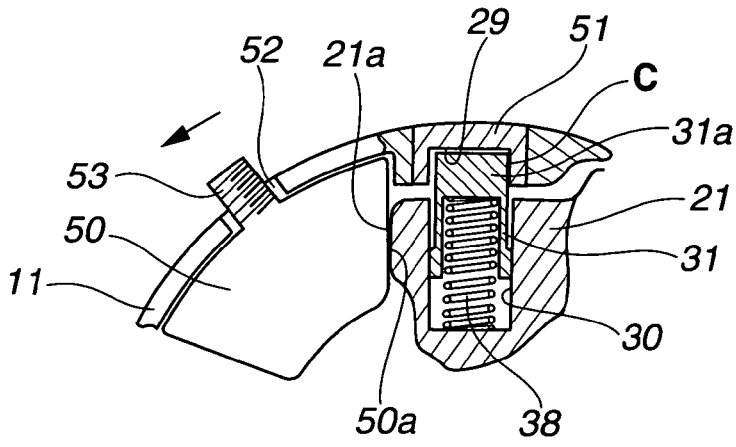
FIG. 12C is a cross-sectional view similar to FIG. 12A but showing a third step of the procedure for the locational adjustment between the lock hole and the lock pin.

Subsequently, the above-mentioned shoe 50 is slightly moved, as shown in FIG. 12C, counterclockwise (in a direction of an arrow) thereby separating the contacting sections of the above-mentioned lock pin 31 and lock hole 29 from each other, so that certain optimum clearance C is formed between lock hole 29 and lock pin 31.

Thereafter, at this state, lock nut 54 is threadably fastened to the upper end section of the above-mentioned guide pin 53, as shown in FIGS. 10 and 11 so that shoe 50 is securely fixed to housing main body 11, and therefore relative positions of lock hole 29 and lock pin 31 are securely fixed in a positioning relationship where one side surface 50*a* of the above-mentioned shoe 50 is in contact with opposite side surface 21*a* of vane 21.

Additionally, if the above-mentioned lock nut 54 is loosened so as to allow shoe 50 to move, the position adjustment between the above-mentioned lock pin 31 and lock hole 29 can be readily accomplished anytime.

As a result, this embodiment also can provide an operational effect similar to that in the above-mentioned second embodiment.

Figure 13:
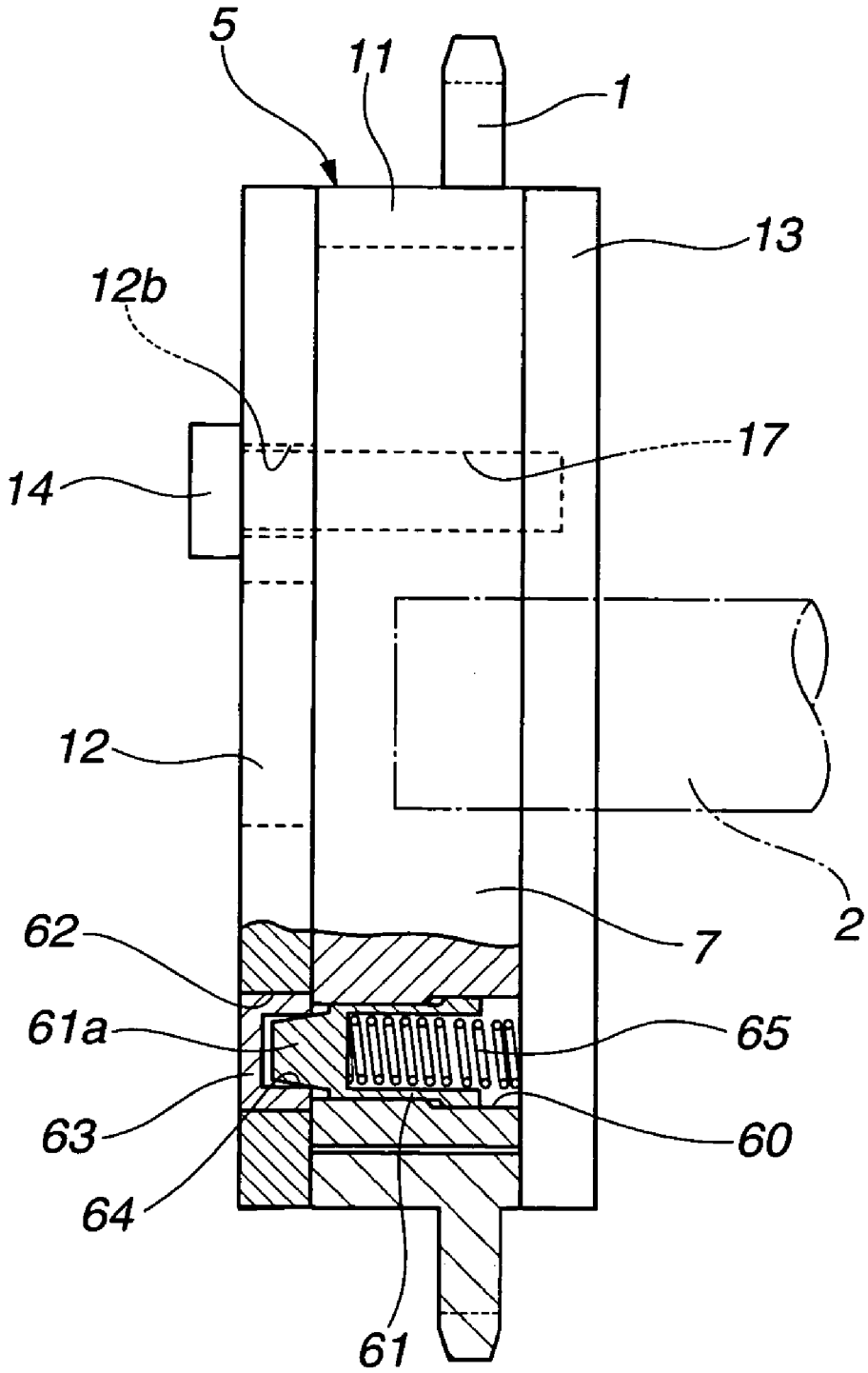
FIG. 13 is a side view partly in cross-section of an essential part of a fourth embodiment of a valve timing control system for an internal combustion engine, according to the present invention.
Figure 14:
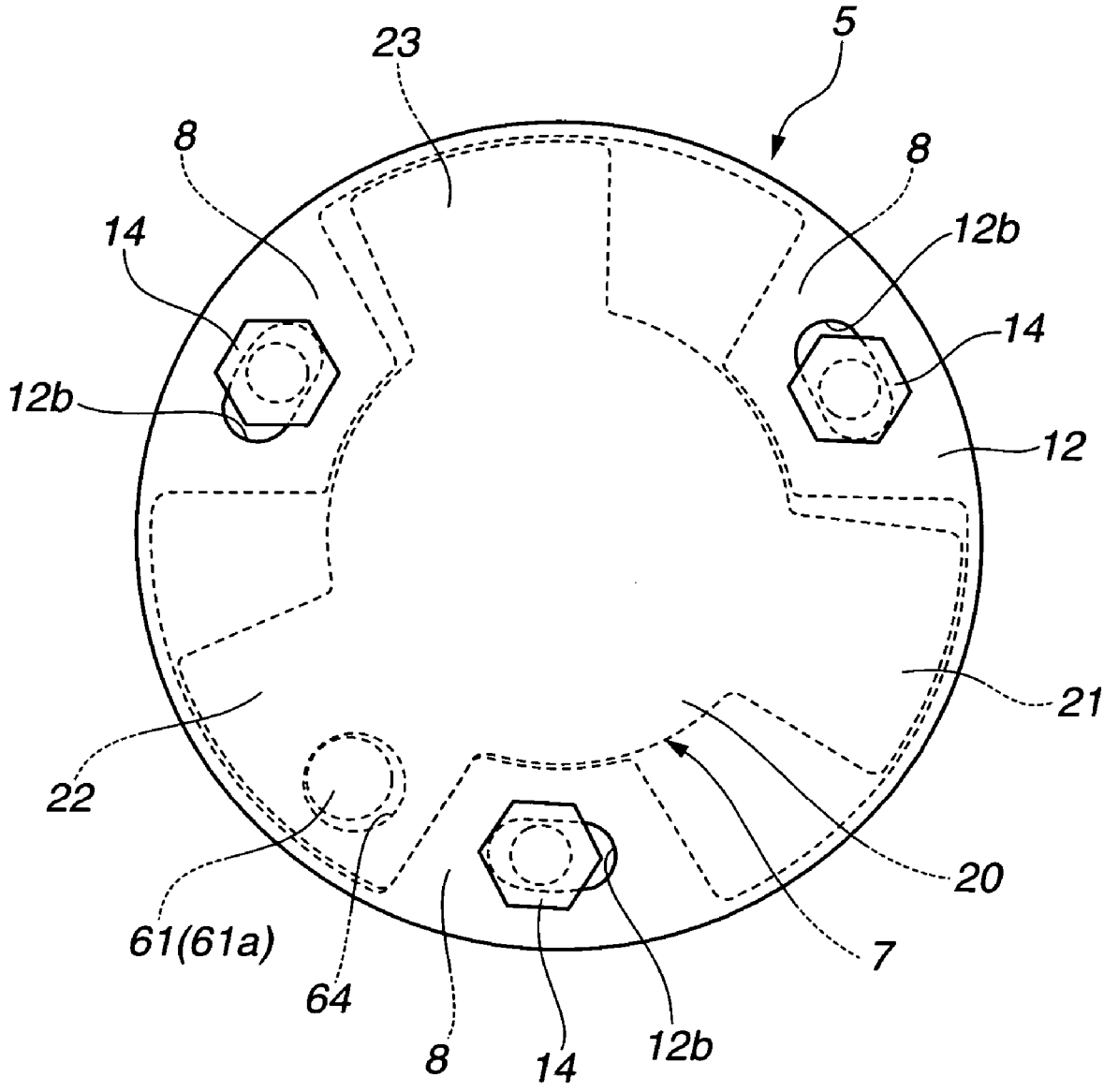
FIG. 14 is a front view of the essential part shown in FIG. 13.

FIGS. 13 and 14 show a fourth embodiment of the valve timing control system according to the present invention, similar to the first embodiment with the exception that the lock mechanism is disposed in the axial direction of cam shaft 2. One vane 23 of the above-mentioned vane member 7 is formed thereinside with sliding hole 60 which extends in the axial direction. Sliding hole 60 accommodates thereinside lock pin 61 which is retained to make its free movement in forward and rearward. On the other hand, front plate 12 of the above-mentioned housing 5 is formed thereinside with supporting hole 62 into which press-fitted member 63 having a C-shape in cross-section is fixed upon press-fitting or the like. This press-fitted member 63 is formed thereinside with lock hole 64 with which the above-mentioned lock pin 61 is engageable and disengageable. This lock hole 64 is set, as shown also in FIG. 14, in such a manner that an inner diameter of lock hole 64 is sufficiently larger than an outer diameter of tip end section 61*a* of the above-mentioned lock pin 61.

The above-mentioned lock pin 61 has tip end section 61*a* formed generally frustoconical. Lock pin 61 is biased in a direction to fittingly enter the above-mentioned lock hole 64 under the biasing force of coil spring 65 loaded between a bottom surface of inside depression of lock pin 61 and an inner surface of rear plate 13.

The above-mentioned front plate 12 is formed with three bolt holes 12*b* each of which is formed elongate generally along a peripheral direction of front plate 12. Front plate 12 is disposed entirely rotatable in its peripheral direction within a certain angular range through elongate bolt holes 12*b*. Consequently, the above-mentioned lock hole 64 is movable in a peripheral direction of housing 5 with the rotation of front plate 12.

Figure 15A:
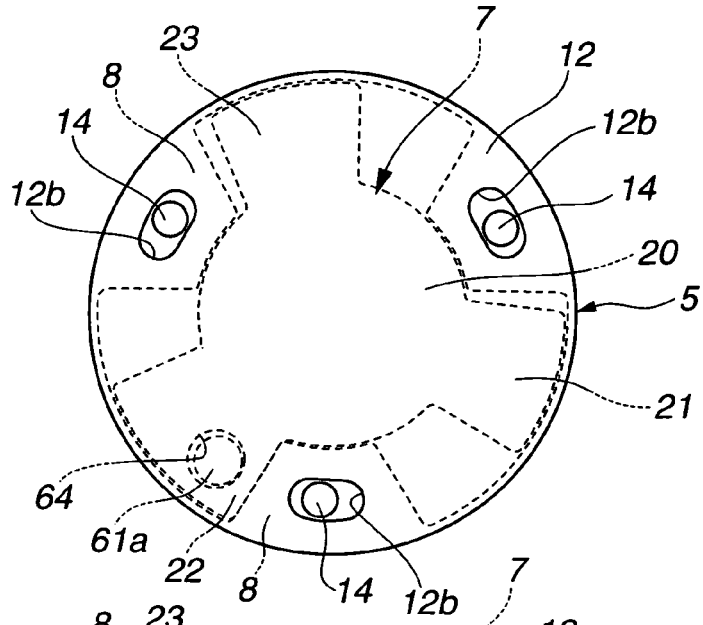
FIG. 15A is a front view of an essential part of the fourth embodiment showing a first step of a procedure for locational adjustment between a lock hole and a lock pin.

Therefore, in order to adjust positioning of lock hole 64 with respect to the above-mentioned lock pin 61 during the installation of various component parts, at first as shown in FIG. 15A, front plate 12 which is temporarily connected to housing 5 through bolts 14 is rotatably moved clockwise to a most rotated position through bolts 14 and elongate bolt holes 12*b*.

Figure 15B:
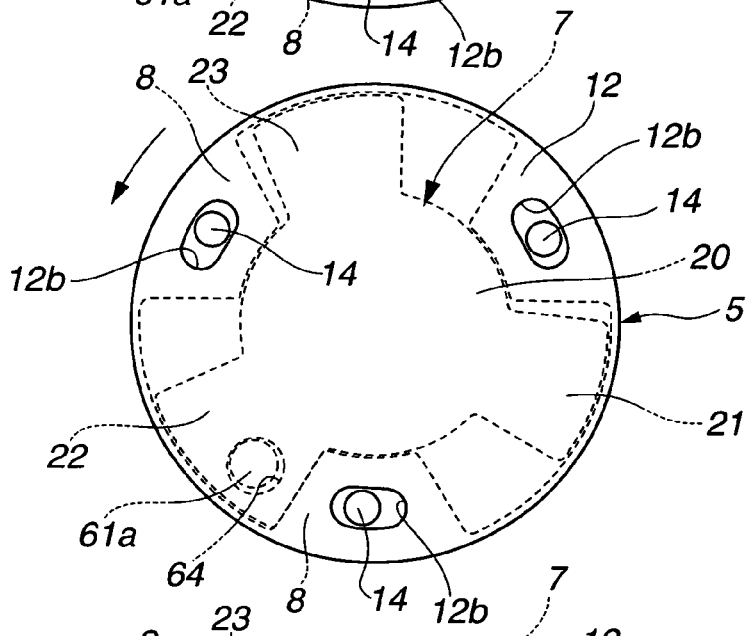
FIG. 15B is a front view similar to FIG. 15A but showing a second step of the procedure for the locational adjustment between the lock hole and the lock pin.

Next, front plate 12 is rotatably moved, as shown in FIG. 15B, counterclockwise (in a direction of an arrow) until the outer peripheral surface of tip end section 61*a* of the above-mentioned lock pin 61 is brought into contact with a part of the opposite inner peripheral surface of lock hole 64.

Figure 15C:
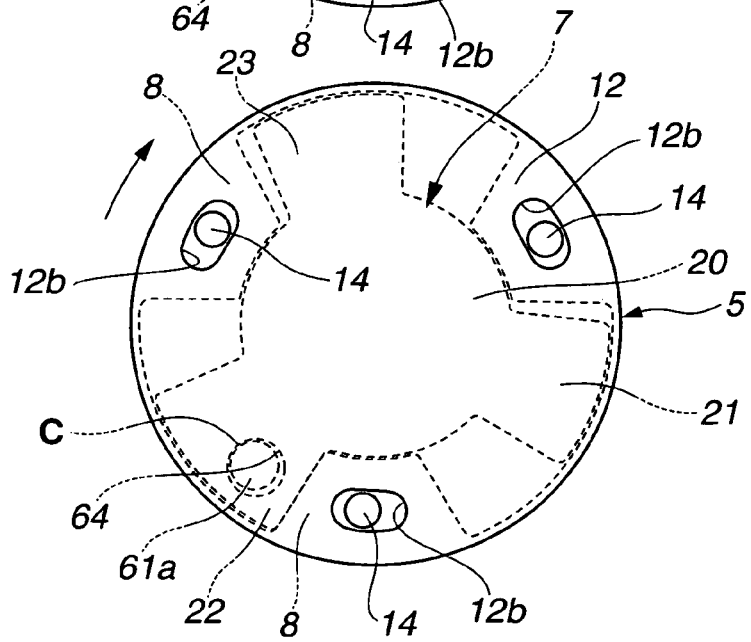
FIG. 15C is a front view similar to FIG. 15A but showing a third step of the procedure for the locational adjustment between the lock hole and the lock pin.

Subsequently, front plate 12 is rotatably moved, as shown in FIG. 15C, in an opposite direction (or clockwise indicated by an arrow) by a slight amount so as to separate the above-mentioned contacting section at the inner peripheral surface of the above-mentioned lock hole 64 from the outer peripheral surface of tip end section 61*a* thereby forming optimum clearance C between the outer peripheral surface of tip end section 61*a* and inner peripheral surface of lock hole 64.

Thereafter, under this state, the above-mentioned bolts 14 are fastened so that front plate 12 is joined with housing main body 11, and additionally the optimum clearance C can be secured between the above-mentioned lock pin 61 and lock hole 64.

As a result, also in this embodiment, operational effects similar to those in the above-mentioned embodiments can be obtained. Additionally, front plate 12 itself is rotatably moved so that the above-mentioned clearance adjustment can be readily accomplished thereby making it possible to carry out the clearance adjustment anytime upon preferably loosening and fastening the above-mentioned bolts 14.

Hereinafter, discussion will be made on technical ideas comprehended from the above embodiments.

(1) A valve timing control system for an internal combustion engine, includes a driving member to which a rotational force is transmitted from a crankshaft. A driven member is rotatable with a cam shaft as a single member. A phase changing mechanism is disposed between the driving member and the driven member to vary a relative rotational phase between the driving member and the driven member within an angular range. A projecting member is disposed to one of side of the driving member and side of the driven member and movable forward and rearward. A contacting section is formed at the other of the side of the driving member and the side of the driven member and contactable with the projecting member when the projecting member is moved forward so as to restrict relative rotational positions of the driving member and the driven member. A releasing mechanism is provided for moving the projecting member rearward in accordance with an engine operating condition so as to release the restriction for the relative rotational positions upon contacting between the projecting member and the contacting section. A position adjusting device is provided for adjusting and fixing relative positions of the projecting member and the contacting section.

With the above idea, for example during assembly and installation of various component parts, the relative positions (defining a clearance) of the projecting member and the contacting section is fixed after adjustment of the relative positions by the above-mentioned position adjusting device. Consequently, it is possible to always accomplish a secure contact between the above-mentioned projecting member and the contacting section at a certain rotational position during operation after the assembly and installation of the various component parts even if the component parts have manufacturing error as conventional.

As a result, it is possible to securely restrict the relative rotational positions of the above-mentioned driving member and the driven member in accordance with the engine operating condition.

(2) A valve timing control system for an internal combustion engine, includes a driving member to which a rotational force is transmitted from a crankshaft. A driven member is rotatable with a cam shaft as a single member. A phase changing mechanism is disposed between the driving member and the driven member to vary a relative rotational phase between the driving member and the driven member within an angular range. A projecting member is disposed to one of side of the driving member and side of the driven member and movable forward and rearward. A section defining a depression is formed at the other of the side of the driving member and the side of the driven member to accommodate the projecting member therein when the projecting member is moved forward to make an engagement between the depression and the projecting member so as to restrict relative rotational positions of the driving member and the driven member. A releasing mechanism is provided for moving the projecting member rearward in accordance with an engine operating condition so as to release the engagement between the projecting member and the depression. A position adjusting device is provided for adjusting and fixing relative positions of the projecting member and the depression.

With the above arrangement, a basic structure is similar to that described in the idea (1) with the exception that the above-mentioned contacting section is formed as the depression serving as an example, so that operational effects similar to those in the idea (1) can be obtained.

(3) A method for assembling a valve timing control system for an internal combustion engine which system includes a driving member to which a rotational force is transmitted from a crankshaft. A driven member is rotatable with a cam shaft as a single member. A phase changing mechanism is disposed between the driving member and the driven member to vary a relative rotational phase between the driving member and the driven member within an angular range. A projecting member is disposed movable to one of side of the driving member and side of the driven member and movable forward and rearward. A contacting section is formed at the other of the side of the driving member and the side of the driven member and contactable with the projecting member when the projecting member is moved forward so as to restrict relative rotational positions of the driving member and the driven member. A releasing mechanism is provided for moving the projecting member rearward in accordance with an engine operating condition so as to release the restriction for the relative rotational positions upon contacting between the projecting member and the contacting section. A position adjusting device is provided for adjusting and fixing relative positions of the projecting member and the contacting section. The method includes the following steps in the order mentioned: (a) restricting a relative rotation between the driving member and the driven member in a condition where the position adjusting device is not operated to fix the relative positions, as a first step; (b) operating the position adjusting device to adjust a clearance between the projecting member and the contacting section, as a second step; and (c) operating the position adjusting device to fix the relative position, as a third step.

With this method, at first, a condition where the driving member and the driven member is restricted is established during assembly of various component parts. Under this condition, the clearance between the above-mentioned projecting member and the contacting section is adjusted by the position adjusting device. Consequently, it is possible to readily and securely adjust the above-mentioned clearance.

(4) A valve timing control system for an internal combustion engine, includes a driving member to which a rotational force is transmitted from a crankshaft. Any one of the driving member and a cam shaft is rotated with a housing as a single member. The housing has at least one operational chamber formed to be divided by a shoe radially inwardly projected. The other one of the above-mentioned driving member and the cam shaft is rotated with a vane rotor as a single member. The other one is accommodated within the above-mentioned housing and has vanes by which the above-mentioned operational chamber is divided into a timing-advancing oil chamber and a timing-retarding oil chamber. A phase changing mechanism is provided to make variable the relative rotational phases of the driving member and the cam shaft by supplying hydraulic oil to or draining hydraulic oil from the above-mentioned timing-advancing chamber and/or the timing retarding chamber. Any one of the above-mentioned housing and the above-mentioned vane rotor is provided with a projecting member which is movable forward and rearward. The other one of the above-mentioned housing and the above-mentioned vane rotor is provided with a contacting section with which the projecting section is contacted when the above-mentioned projecting section is moved forward in a state where the above-mentioned vane is in contact with the above-mentioned shoe so as to restrict the relationship between the above-mentioned housing and the above-mentioned vane rotor. A releasing mechanism is provided for releasing the restriction between the above-mentioned projecting section and the above-mentioned contacting section by moving the projecting section rearward in accordance with an engine operative condition. A position adjusting device or means is provided for adjusting and fixing a relative positions of the above-mentioned projecting member and the contacting section.

According to this idea, operational effects similar to those described in the idea (1) can be obtained.

(5) A valve timing control system for an internal combustion engine, includes a driving member to which a rotational force is transmitted from a crankshaft. Any one of the driving member and a cam shaft is rotated with a housing as a single member. The housing has at least one operational chamber formed to be divided by a shoe radially inwardly projected. The other one of the above-mentioned driving member and the cam shaft is rotated with a vane rotor as a single member. The other one is accommodated within the above-mentioned housing and has vanes by which the above-mentioned operational chamber is divided into a timing-advancing oil chamber and a timing-retarding oil chamber. A phase changing mechanism is provided to make variable the relative rotational phases of the driving member and the cam shaft by supplying hydraulic oil to or draining hydraulic oil from the above-mentioned timing-advancing chamber and/or the timing retarding chamber. Any one of the above-mentioned housing and the above-mentioned vane rotor is provided with a projecting member which is movable forward and rearward. The other one of the above-mentioned housing and the above-mentioned vane rotor is provided with a depression into which the projecting section is accommodated when the above-mentioned projecting section is advanced in a state where the above-mentioned vane is in contact with the above-mentioned shoe so as to restrict the relationship between the above-mentioned housing and the above-mentioned vane rotor. A releasing mechanism is provided for releasing the engagement between the above-mentioned projecting section and the above-mentioned depression by moving the projecting section rearward in accordance with an engine operating condition. A position adjusting device or means is provided for adjusting and fixing relative positions of the above-mentioned projecting member and the contacting section.

According to this idea, operational effects similar to those described in the idea (2) can be obtained.

(6) The method for assembling a valve timing control system for an internal combustion engine as described in the idea (3), in which at the second step, first the above-mentioned position adjusting device is operated in one direction so as to contact the above-mentioned projecting member with a part of the contacting section. Thereafter, the above-mentioned position adjusting device is operated in an opposite direction until a certain clearance is formed so as to adjust the above-mentioned clearance.

(7) The valve timing control system for an internal combustion engine as described in any of the ideas (1), (2), (4) and (5), in which the above-mentioned position adjusting device has an adjusting member for adjusting the clearance between the above-mentioned projecting member and the contacting section, and a fixing device by which a rotational operation of the adjusting member is fixable.

(8) The valve timing control system for an internal combustion engine as described in the ideas (3) or (6), in which the above-mentioned position adjusting device has an adjusting member for adjusting the clearance between the above-mentioned projecting member and the contacting section upon rotational operation of the adjusting member, and a fixing device by which rotational operation of the adjusting member is fixable.

(9) The valve timing control system for an internal combustion engine as described in the idea (7), in which the above-mentioned adjusting member has an arcuate surface eccentric to a rotational center of the adjusting member.

(10) The method for assembling a valve timing control system for an internal combustion engine as described in the idea (8), in which the above-mentioned adjusting member has an arcuate surface eccentric to a rotational center of the adjusting member.

(11) The valve timing control system for an internal combustion engine as described in the ideas (2) or (5), in which the above-mentioned position adjusting device has an adjusting member for changing the position of the above-mentioned projecting member or the above-mentioned depression upon rotational operation of the adjusting member, and a fixing device or means being able to restrict the rotation of the adjusting member.

(12) The valve timing control system for an internal combustion engine as described in the idea (11), in which the above-mentioned depression is formed as a hole having a circular shape in cross-section.

(13) The valve timing control system for an internal combustion engine as described in any of the ideas (8), (9), (11) and (12), in which the above-mentioned fixing device has a certain hole for press-fitting and a press-fitting section provided at the above-mentioned adjusting member to be press-fitted into the above-mentioned hole for press-fitting.

According to this idea, the above-mentioned adjusting member is fixed through the above-mentioned press-fitting section after adjustment of the above-mentioned clearance by the adjusting member. Therefore, the above-mentioned adjusting member can be prevented from being carelessly rotated after the position adjustment. As a result, it is possible to maintain the above-mentioned clearance stably and certainly.

(14) The valve timing control system for an internal combustion engine as described in the idea (13), in which the above-mentioned press-fitting section has a step section provided at the above-mentioned adjusting member.

(15) The valve timing control system for an internal combustion engine as described in any of the ideas (8), (9), (11) to (14), in which the above-mentioned adjusting member has a noncircular portion through which the above-mentioned adjusting member is possible to be rotationally operated from outside.

According to this idea, the clearance adjustment is accomplished by the position adjusting device in such a manner that the above-mentioned adjusting member is rotationally operated through the noncircular portion in a state where the adjusting member is temporary fixed to a certain member, thereby facilitating an adjustment operation.

(16) The valve timing control system for an internal combustion engine as described in any of the ideas (8), (9), (11) to (15), in which the above-mentioned fixing device has a position allowance section provided at the above-mentioned adjusting member so as to allow a position in a rotational direction of the adjusting member to change, and a bolt disposed within the position allowance section so that the above-mentioned adjusting member can be held through a head section.

According to this idea, the above-mentioned adjusting member or the like can be again assembled upon loosening and fastening the above-mentioned bolt after installation of various component parts, i.e., the adjusting member has been fixed by the above-mentioned fixing device, so that it is possible to accomplish a fine adjustment of the above-mentioned clearance many times after the assembly of the various component parts.

(17) The valve timing control system for an internal combustion engine as described in the idea (4), in which the above-mentioned position adjusting device makes the above-mentioned shoe contactable with the above-mentioned vane to be rotationally movable in a peripheral direction and fixable at a certain position.

(18) The valve timing control system for an internal combustion engine as described in the idea (16), in which the above-mentioned housing whose one end side is covered with a plate fixed through bolts; the above-mentioned projecting member is accommodated within the above-mentioned vane rotor to be movable in forward and rearward along an axial direction of the cam shaft; and the above-mentioned depression is formed at the above-mentioned plate.

According to this idea, it is possible to adjust the position of the depression with respect to the above-mentioned projecting member only by rotating the plate in case that the above-mentioned plate is formed with the depression.

(19) The valve timing control system for an internal combustion engine as described in any of the ideas (1) to (3), in which the above mentioned projecting member is constituted as a pin whose tip end section is cylindrical and contactable with the above-mentioned contacting section.

According to this idea, the tip end section of the pin is formed cylindrical so that it is possible to equalize the entire clearance between the above-mentioned tip end section and the above-mentioned contacting section as compared with a case in which the tip end section is formed, for example, tapered. Furthermore, the clearance can be set as small as possible so that it is possible to suppress slapping noise generated between the tip end section and the contacting section. As a result, this embodiment is effective to prevent foreign noise from generation between the above-mentioned tip end section and the contacting section.

It will be understood that the present invention is not limited to the configurations in the above embodiments. For example, the clearance adjustment may be accomplished with position adjusting device by which the position of the projecting member is changed. Additionally, it is also possible to form a projecting portion of this projecting member as a detection section which detects the rotational position of the above-mentioned housing is detected with a sensor.

The above-mentioned phase changing mechanism is not limited to one operated with hydraulic pressure and may be one electrically operated, for example, with an electric motor or an electromagnetic brake.

The tip end section of the above-mentioned projecting member is not limited to the cylindrical one and may be spherical one, or polygonal one in cross-section, or is formed frustoconical (tapered).

A portion of the inner peripheral surface of the above-mentioned depression corresponds to the above-mentioned contacting section. The contacting section may be formed of a mere step section in cross-section.

The forward and rearward movements of the above-mentioned projecting member are accomplished not only by hydraulic pressure and a spring but also by using electromagnetic force.

The above-mentioned driving member is not only driven through a chain but also through a pulley on which a timing belt is passed on or with engagement of gears.

The above-mentioned housing may be fixed with the cam shaft, while the vane rotor may be joined with the driven member as a single member. Additionally, it is possible to dispose the projecting member to the above-mentioned housing, while forming the contacting section or the depression in the vane rotor.

The above-mentioned vane rotor is not limited to one in which its rotation is restricted at the most timing-retarded position of the housing, and may be one in which its rotation is restricted at the most timing-advancing position of the housing.

The position at which the above-mentioned vane and the shoe are brought into contact with each other is not necessary to be adjacent to a position restricted with the above-mentioned projecting member.

It is also possible to use the vane and the vane rotor which are separated from each other.

The entire contents of Japanese Patent Application No. 2005-035347, filed Feb. 14, 2005 is incorporated herein by reference.

What is claimed is:

1. A valve timing control system for an internal combustion engine, comprising:

a driving member to which a rotational force is transmitted from a crankshaft;

a driven member rotatable with a cam shaft as a single member;

a phase changing mechanism disposed between said driving member and said driven member to vary a relative rotational phase between said driving member and said driven member within an angular range;

a projecting member disposed to one of side of said driving member and side of said driven member and movable forward and rearward;

a contacting section formed at the other of the side of said driving member and the side of said driven member and contactable with said projecting member when said projecting member is moved forward so as to restrict relative rotational positions of said driving member and said driven member;

a releasing mechanism for moving said projecting member rearward in accordance with an engine operating condition so as to release the restriction for the relative rotational positions upon contacting between said projecting member and said contacting section; and a position adjusting device for adjusting and fixing relative positions of said projecting member and said contacting section.

2. A valve timing control system for an internal combustion engine, comprising:

a driving member to which a rotational force is transmitted from a crankshaft;

a driven member rotatable with a cam shaft as a single member;

a phase changing mechanism disposed between said driving member and said driven member to vary a relative rotational phase between said driving member and said driven member within an angular range;

a projecting member disposed to one of side of said driving member and side of said driven member and movable forward and rearward;

a section defining a depression formed at the other of the side of said driving member and the side of said driven member to accommodate said projecting member therein when said projecting member is moved forward to make an engagement between said depression and said projecting member so as to restrict relative rotational positions of said driving member and said driven member;

a releasing mechanism for moving said projecting member rearward in accordance with an engine operating condition so as to release the engagement between said projecting member and said depression; and a position adjusting device for adjusting and fixing relative positions of said projecting member and said depression.

3. A method for assembling a valve timing control system for an internal combustion engine, the system including:

a driving member to which a rotational force is transmitted from a crankshaft;

a driven member rotatable with a cam shaft as a single member;

a phase changing mechanism disposed between said driving member and said driven member to vary a relative rotational phase between said driving member and said driven member within an angular range;

a projecting member disposed movable to one of side of said driving member and side of said driven member and movable forward and rearward;

a contacting section formed at the other of the side of said driving member and the side of said driven member and contactable with said projecting member when said projecting member is moved forward so as to restrict relative rotational positions of said driving member and said driven member;

a releasing mechanism for moving said projecting member rearward in accordance with an engine operating condition so as to release the restriction for the relative rotational positions upon contacting between said projecting member and said contacting section; and a position adjusting device for adjusting and fixing relative positions of said projecting member and said contacting section, the method comprising the following steps in the order mentioned:

restricting a relative rotation between said driving member and said driven member in a condition where said position adjusting device is not operated to fix the relative positions, as a first step;

operating said position adjusting device to adjust a clearance between said projecting member and said contacting section, as a second step; and operating said position adjusting device to fix the relative positions, as a third step.

* * * * *